US008028968B2

(12) United States Patent
Gum

(10) Patent No.: US 8,028,968 B2
(45) Date of Patent: Oct. 4, 2011

(54) VARIABLE ORIFICE GAS FLOW MODULATING VALVE

(76) Inventor: Mike Gum, West Plains, MO (US)

( * ) Notice: Subject to any disclaimer, the term of this patent is extended or adjusted under 35 U.S.C. 154(b) by 665 days.

(21) Appl. No.: 11/751,854

(22) Filed: May 22, 2007

(65) Prior Publication Data

US 2008/0293000 A1 Nov. 27, 2008

(51) Int. Cl.
*F16K 47/00* (2006.01)

(52) U.S. Cl. ..... 251/122; 236/1 A; 137/601.19

(58) Field of Classification Search ..... 251/117–118, 251/120–122; 236/1 A, 15 R, 20 R, 26 A; 137/601.18, 601.19
See application file for complete search history.

(56) References Cited

U.S. PATENT DOCUMENTS

| | | | | |
|---|---|---|---|---|
| 1,185,970 | A * | 6/1916 | Bower | 239/574 |
| 1,525,733 | A * | 2/1925 | Haskell, Jr. | 251/122 |
| 1,759,892 | A * | 5/1930 | Doen | 137/613 |
| 2,514,506 | A * | 7/1950 | Mueller | 137/599.16 |
| 3,090,423 | A * | 5/1963 | Atterbury, Jr. et al. | 236/75 |
| 3,402,739 | A * | 9/1968 | Kass | 137/628 |
| 4,930,488 | A | 6/1990 | Pearman et al. | |
| 4,947,891 | A * | 8/1990 | Genbauffe | 137/599.17 |
| 5,009,393 | A * | 4/1991 | Massey | 251/207 |
| 5,234,196 | A | 8/1993 | Harris | |
| 5,249,773 | A * | 10/1993 | Feld | 251/129.11 |
| 5,458,294 | A | 10/1995 | Zachary et al. | |
| 5,979,484 | A | 11/1999 | Grando et al. | |
| 6,029,705 | A | 2/2000 | Happe | |
| 6,287,108 | B1 | 9/2001 | Rothenberger et al. | |
| 6,968,853 | B2 | 11/2005 | Amazorrain | |
| 7,201,186 | B2 | 4/2007 | Ayastuy | |
| 7,287,551 | B2 * | 10/2007 | James | 137/629 |

OTHER PUBLICATIONS

Patriot Supply; Robertshaw Single Gas Valve; www.patriot-supply.com/products/showitem.cfm/7449; Dtd: May 14, 2007.

* cited by examiner

*Primary Examiner* — John K Fristoe, Jr.
*Assistant Examiner* — Marina Tietjen
(74) *Attorney, Agent, or Firm* — Hovey Williams LLP

(57) ABSTRACT

A temperature control system for a gas appliance utilizes an improved variable orifice gas flow modulating valve (10) capable of direct modulation of gas flow through an orifice (20) directly into a gas burner (54) to provide a constantly maintained temperature in an appliance working compartment, as selected by human interface via a temperature selector. An actuator (12) attached to a gas fitting body (14) of the valve provides for linear movement of a metering pin (16) into the taper inside the orifice, accomplishing the variable controlled modulated flow of gas directly into the burner. The actuator (12) is controlled by an input signal from a programmable controller (90) whose output is determined by calculations based on inputs from a temperature selector and a temperature sensor located in the gas appliance working compartment.

15 Claims, 12 Drawing Sheets

54
58
170
176
178
182
198
198
208
210
212
214
216
216
218
220
220
222
224
172

VARIABLE ORIFICE GAS FLOW MODULATING VALVE

BACKGROUND

1. Field

Embodiments of the present technology relate to gas valves for use in gas appliances. More particularly, embodiments of the technology involve a variable gas valve for modulating a flow of gas into a burner of a gas appliance.

2. Description of the Related Art

Gas valves are used to regulate an amount of gas fed to a gas appliance such as, for example, an oven, furnace, hot water heater, or fireplace. Gas valves have traditionally had two settings, on and off. Use of such valves causes undesirable fluctuations in appliance output. An oven set at 350°, for example, may fluctuate between 345° and 355° as the oven temperature control cycles through on at 345°, off at 355°, and then back on at 345°.

To address the problem of output fluctuation in gas appliances, variable gas valves were developed to modulate gas flow across a range of outputs instead of between an on position and an off position. Such variable gas valves enable output control systems to operate with less fluctuations than a traditional on/off type gas valve. Unfortunately, variable gas valves suffer from various problems and limitations. For example, modulating gas flow in variable gas valves affects the gas-air mixture, causing undesirable combustion of the mixture, such a "lazy yellow" flame instead of a "hard blue" flame.

U.S. Pat. No. 6,968,853 relates to a motor-operated valve for regulating gas flow, the valve being a lift-type modulating valve with a cut-off member providing a modulated flow between a minimum and maximum flow, and a safety shut-off means in the event of a locked motor rotation.

U.S. Pat. No. 6,287,108 discloses a method and apparatus for accurately and reproducibly setting a volumetric gas flow through a gas feed line to a burner nozzle of a gas-operated cooking or baking appliance as required for a desired burner heat output. A control system uses actual flow measurements from a gas flow meter and makes gas flow adjustments by means of an actuator operated valve accordingly.

U.S. Pat. No. 6,029,705 relates to a gas control valve for effecting the largest possible manipulation of visible flames in, for example, a gas-heated fireplace or similar device. A first valve includes a switch and control device facilitating operation and supervision of a burner by turning a flow of the gas on and off. A second valve manages pressure control and adjustment of the flame height by regulating a volume of gas flowing to the burner. A battery-operated, motor-driven actuator drives one of the two valves.

U.S. Pat. No. 5,979,484 relates to a safety and regulation valve including a reversible motor actuator acting on a movable device. The movable device is movable between an on position, an off position, and a plurality of intermediate positions for varying a volume of gas flow.

U.S. Pat. No. 5,458,294 provides a variable-orifice, solenoid-operated valve as a control device to meter gas flow as a function of sensed temperature and desired temperature.

U.S. Pat. No. 5,234,196 discloses a gas modulating valve for use with a gas burner. The valve accomplishes modulation through the use of two sliding plates positioned next to each other that have orifice holes that result in a reduced orifice passageway when the two plates are misaligned with each other. One of two variations disclosed discharges a gas jet directly into a mixing tube of a gas burner, while a second variation operates as an in-line gas modulating valve.

U.S. Pat. No. 4,930,488 relates to a microprocessor-controlled gas appliance comprised essentially of a computer control system and a microprocessor-actuated modulating gas valve.

SUMMARY OF THE INVENTION

Embodiments of the present invention provide an improved gas valve that does not suffer from the problems and limitations of the prior art. Particularly, embodiments of the present invention provide a variable orifice gas flow modulating valve comprising an orifice hood, a metering pin, and an actuator for moving one of the metering pin or the orifice hood relative to the other of the metering pin or the orifice hood.

The orifice hood may include a wall defining a recess and an outlet orifice. The recess includes a tapered section that narrows from a wide portion to a narrow portion, and the outlet orifice extends from the narrow portion of the recess through the wall to an outer surface of the orifice hood.

The metering pin may include a central portion and a plurality of fins. The central portion extends along a length of the metering pin and each of the fins extends radially outwardly from the central portion. The fins and central portion may be tapered at an end of the metering pin such that the tapered portion of the metering pin conforms to the tapered section of the recess. The metering pin includes a passage for allowing gas to pass through the metering pin to the outlet orifice.

The actuator moves the pin or the hood between an open position where the metering pin is separated from the tapered section of the recess by a distance and allows gas to flow around an outer surface of the tapered portion of the pin to the outlet orifice, and a closed position where the tapered portion of the metering pin is seated against the tapered section of the recess and restricts substantially all gas flow to the passage of the metering pin and the outlet orifice.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

Preferred embodiments of the present invention are described in detail below with reference to the attached drawing figures, wherein.

DETAILED DESCRIPTION

Figure 1:
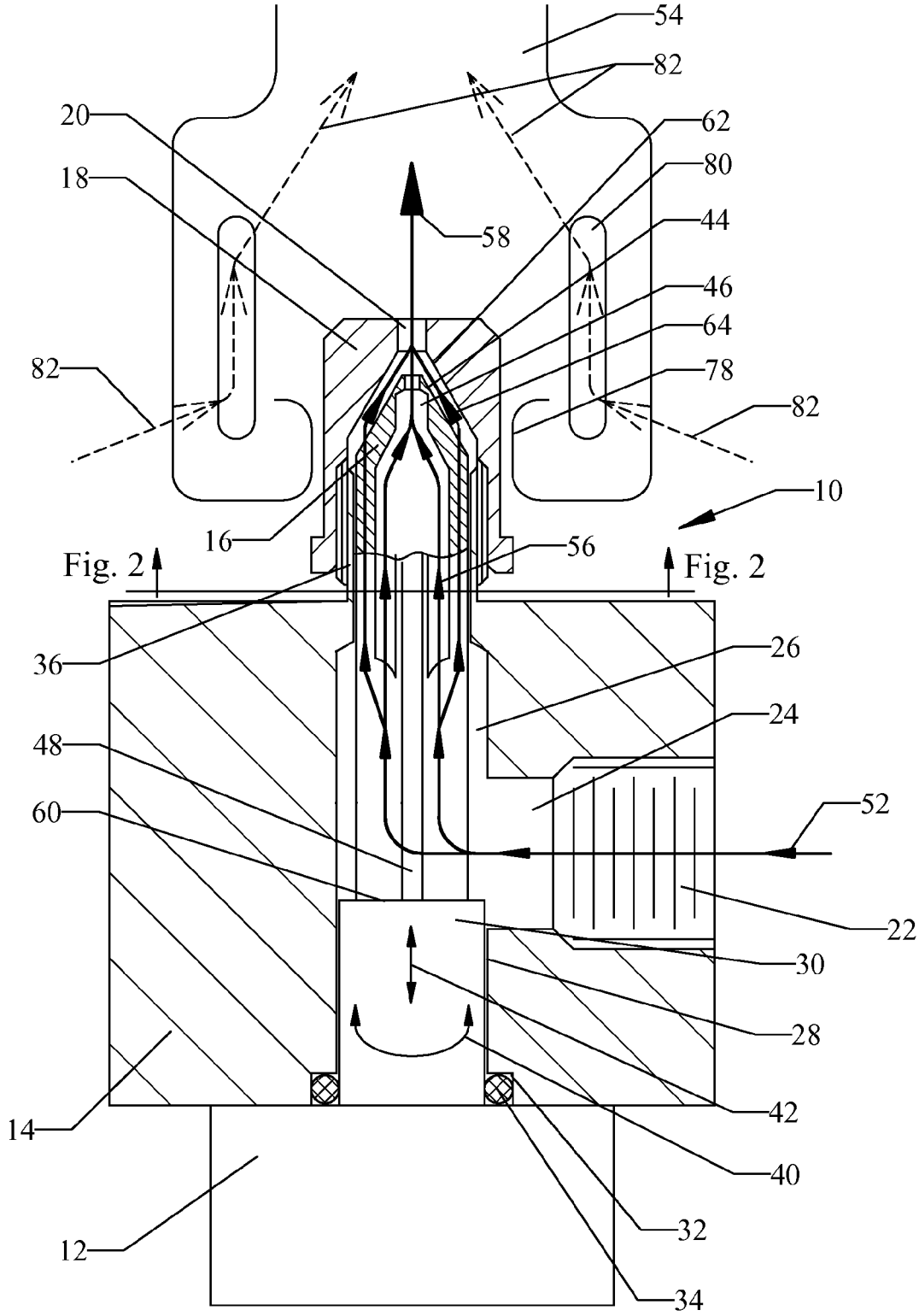
FIG. 1 is a side elevation view of a variable orifice gas flow modulating valve incorporating principles of the present technology according to a first implementation.

A gas valve incorporating principles of the present teachings according to a first implementation is illustrated in FIG. 1 and designated generally by the reference numeral 10. The gas valve 10 generally comprises an actuator 12, a gas fitting body 14, a metering pin 16, and an orifice hood 18. The actuator 12 causes the pin 16 to move relative to the fitting body 14 and the orifice hood 18 to vary an amount of gas passing through an outlet orifice 20.

Figure 2:
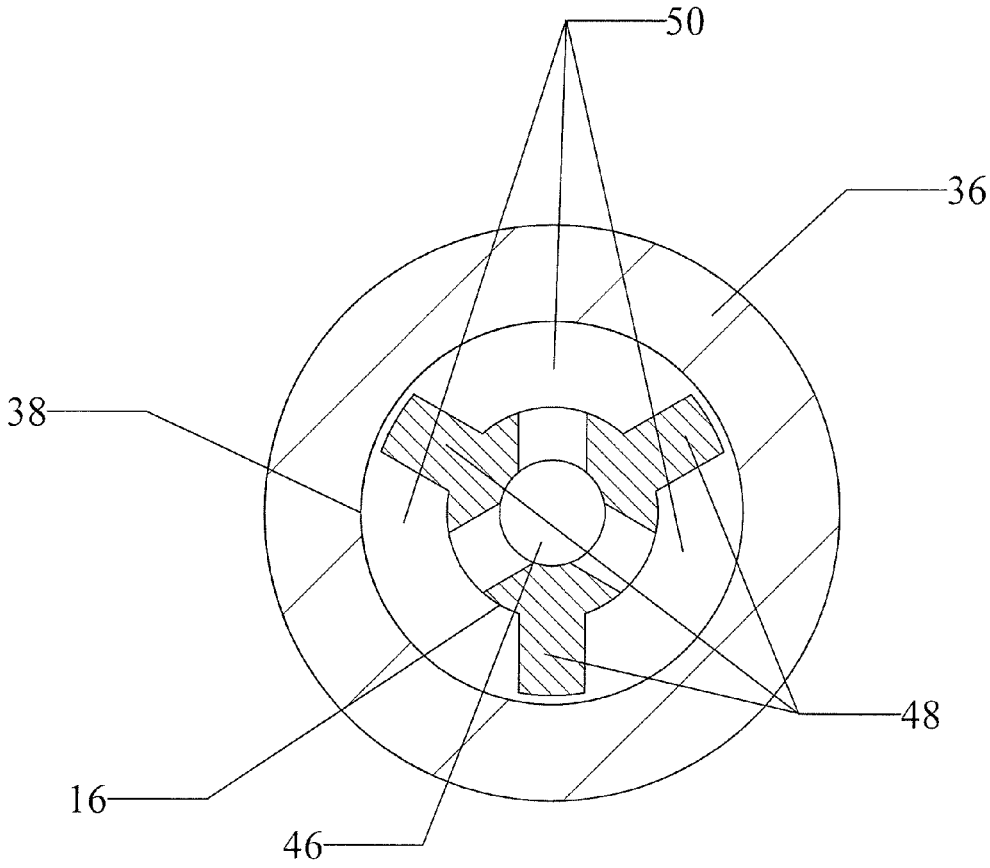
FIG. 2 is a cross-sectional view of a metering pin and a fitting outlet taken along line 2-2 of FIG. 1.

The gas fitting body 14 comprises a gas inlet connection 22 for connecting to a gas supply line, an internal passageway from the inlet connection 22 to the metering pin 16, the internal passageway including a first portion 24 and a second portion 26, a bore 28 for receiving and guiding a motor shaft 30 during operation, and a counterbore 32 adjacent the bore 28 for receiving an o-ring 34 to provide a gas-tight seal between the gas fitting body 14 and the actuator shaft 30. Referring also to FIG. 2, an outlet port 36 of the gas fitting body 14 generally extends into a recess of the orifice hood 18 and includes a precision-machined bore 38 for alignment of the metering pin 16. The outlet port 36 may further include external threads for engaging the orifice hood 18, as explained below in greater detail.

The actuator 12 may be a stepper motor or similar device and is securely attached to a first end of the gas fitting body 14 via traditional means including, for example, rivets, screws, bolts, welded links, or similar attachment means. The actuator shaft 30 operates axially through the bore 28. Thus, the bore 28 is preferably machined with a surface finish to provide adequate clearance and alignment of the shaft 30 during operation. Furthermore, surfaces of the shaft 30 and the counterbore 32 preferably have a high-quality surface finish sufficient for providing a gas-tight seal with the o-ring 34 placed around the shaft 30 and seated in the counterbore 32. Though not essential for operation, it may be desirable that the o-ring 34 be of such material, type, cross-sectional shape, coating and surface quality as to exceed all gas industry and associated certification agencies standards, specifications and requirements, taking into account that the shaft 30 will exhibit both rotational 40 and linear 42 movement during operation.

The metering pin 16 is generally elongated with a cylindrical central core extending substantially from a first end of the pin 16 adjacent the actuator shaft 30 to a metering end 44 of the pin 16. The cylindrical central core includes a bore or center hole 46 extending longitudinally from approximately a middle of the pin 16 to the metering end 44 of the pin 16. A plurality of fins 48 extend radially outwardly from the cylindrical central core, and extend axially from the first end of the pin 16 to the metering end 44 of the pin 16. The fins 48 generally define fluid passageways 50, such that in operation gas flows in the inlet connection 22 generally along path 52, through the internal passageway, along the gas passageways 50 defined by the fins 48 and indicated by path 56, and through the center hole 46, and ultimately out the orifice 20 into a burner 54 as indicated by path 58. While the illustrated pin 16 includes three fins 48 approximately equally radially spaced about the central core, it will be appreciated that virtually any number of fins may be used and spaced at unequal intervals.

While the fins 48 extend substantially the entire length of the pin 16, a radially-inward recess of each of the fins 48 extends from approximately a middle section of the pin 16 toward the metering end 44 of the pin 16. The recessed portion of the fins 48 and the center hole 46 provide an enlarged, central passage for gas to flow toward the metering end 44 of the pin 16.

The first end of the metering pin 16 is secured to the actuator shaft 30 by threading, press fit, weld, cross-pin, or some other similar attachment method, onto an end 60 of the shaft 30. Though not essential to use and operation of the present technology, it may be desirable that such attachment method exceed the life expectancy of all associated standards, specifications, and requirements.

The size of the fins 48 is sufficient to provide clearance within the bore 38 to allow for movement of the metering pin 16 during functional operation, while maintaining axial alignment with the orifice hood 18. The center hole 46 through the metering pin 16 provides for a central gas flow path to the outlet orifice 20 of the orifice hood 18. The metering end 44 of the metering pin 16, and an internal countersink 62 of the orifice hood 18, are both machined with matching angle tapers such that the gas flow at point 64 approaching the orifice 20 is gradually constricted, reducing or modulating the exiting gas flow 58, as the motor shaft 30 is operated to cause the metering end 44 to approach closer to the orifice hood countersink surface 62.

The actuator 12 moves the pin 16 between an open position where the metering pin 16 is separated from the tapered section of the countersink 62 by a distance and allows gas to flow around an outer surface of the tapered portion of the pin 16 to the outlet orifice 20, and a closed position where the tapered portion of the metering pin 16 is seated against the tapered section of the countersink 62 and restricts substantially all gas flow to the center hole 46 of the metering pin and the outlet orifice 20. As explained below, a central system may position the pin 16 at any point between the open position and the closed position to maintain a substantially constant gas flow.

Figure 3:
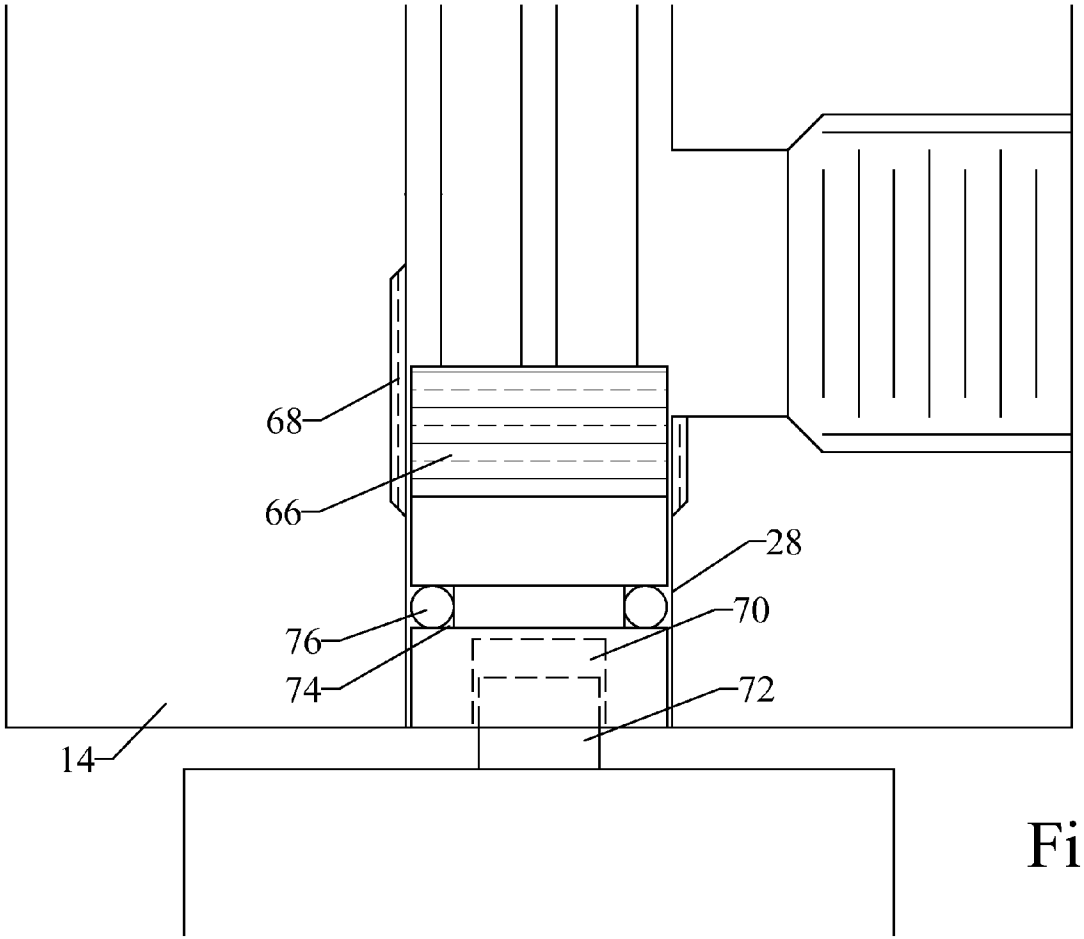
FIG. 3 is a side elevation view of a metering pin that may be used with the valve of FIG. 1.

An alternative construction of a metering pin 16 is illustrated in FIG. 3 having external threads 66 that assemble into matching internal threads 68 in the internal bore 28 of the gas fitting body 14, having a countersunk drive socket 70 on the first end for receiving a sliding fit external drive shaft 72 from the stepper motor, with an undercut groove 74 for receiving an o-ring 76 as a sealing member to provide a gas tight seal with internal bore 28 of the gas fitting body 14.

Figure 5:
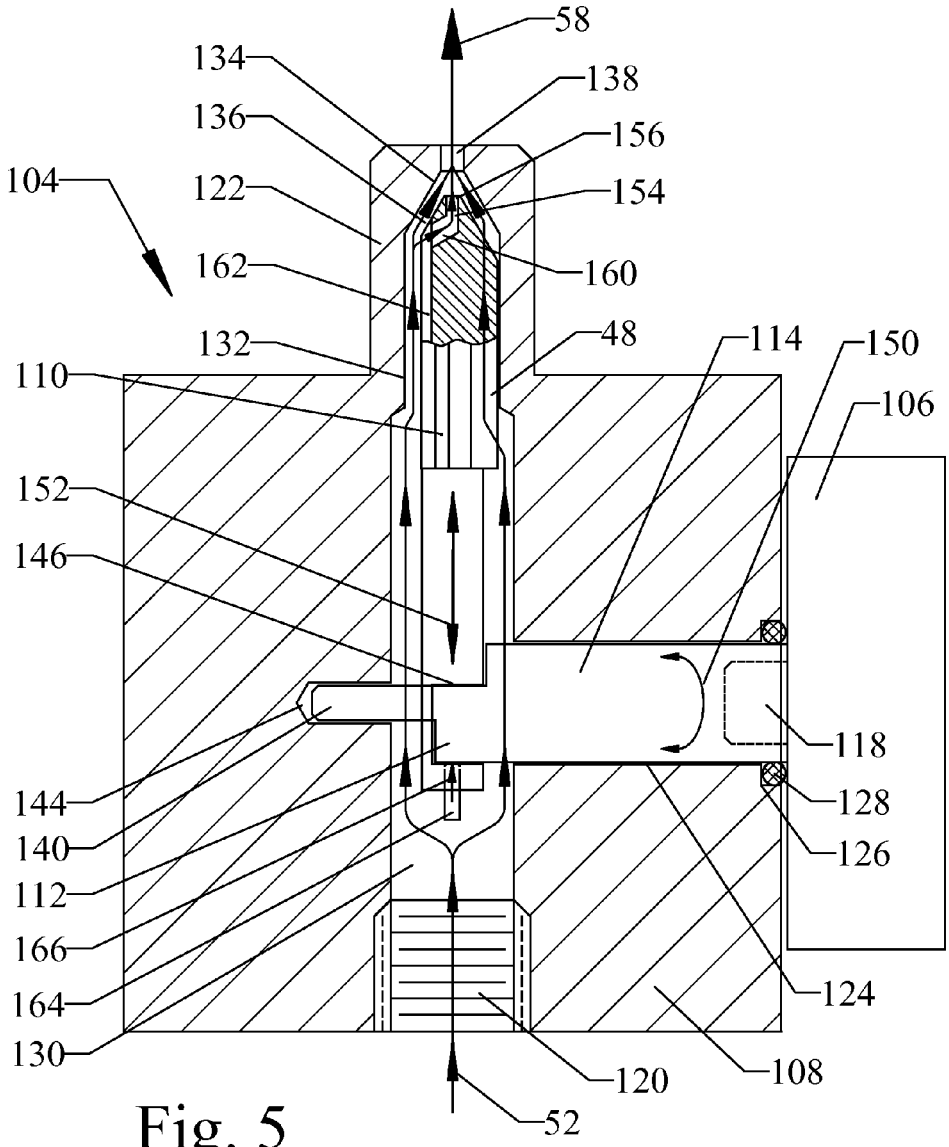
FIG. 5 is a variable orifice gas flow modulating valve incorporating principles of the present technology according to a second implementation, the valve including an actuator attached to a side of a gas fitting body.

Alternatively, a one-piece construction of a metering pin 16 could be used by, for example, machining the metering pin 16 and associated metering end 44 configuration directly on the end of the motor shaft 30, thus eliminating the assembly joint and associated manufacturing costs. A one-piece construction of the orifice hood 18 machined as part of the gas fitting body 14 is illustrated in FIG. 5.

The orifice hood 18 is illustrated in FIG. 1 inserted into a burner inlet port 78 of the gas oven burner 54. The burner 54 may have manually adjustable air-intake ports 80 providing primary air intake 82 during operation of the appliance. The volume of primary air intake 82 is related to the velocity of the exiting gas 58 and the resultant venturi action that it produces in the inlet area of the burner 54, this volume of primary air 82 facilitating complete combustion of the gas flow 58 at the burner 54. In other words, the exiting gas 58 causes a venturi action, and a greater venturi action causes more primary air to be drawn into the burner mixer tube, and more primary air may result in more complete combustion and the desired "hard blue" flame. As explained above in the section titled "RELATED ART," complete combustion is often a desirable attribute as it produces a hotter flame and prevents emission of incomplete combustion flue gases exhausting from the appliance, among other things.

The constant pressure gas flow 52 is delivered to the gas fitting body 14 through the gas supply line inlet connection 22. The gas passes through the inlet port 22 into the internal passageway portion 26, and then through the three gas passageways 50 formed by the fins 48 of the metering pin 16. It may be desirable to employ proven techniques, shapes, contours, profiles and clearances in the design of the gas passageways 24, 26, and 50 so that gas flow 52 to the metering pin end 44 is maximized, and the gas supply at point 64 is maintained at a constant pressure to facilitate maximum velocity of the gas flow 58 exiting the orifice 20 for improved combustion as previously discussed.

Figure 4:
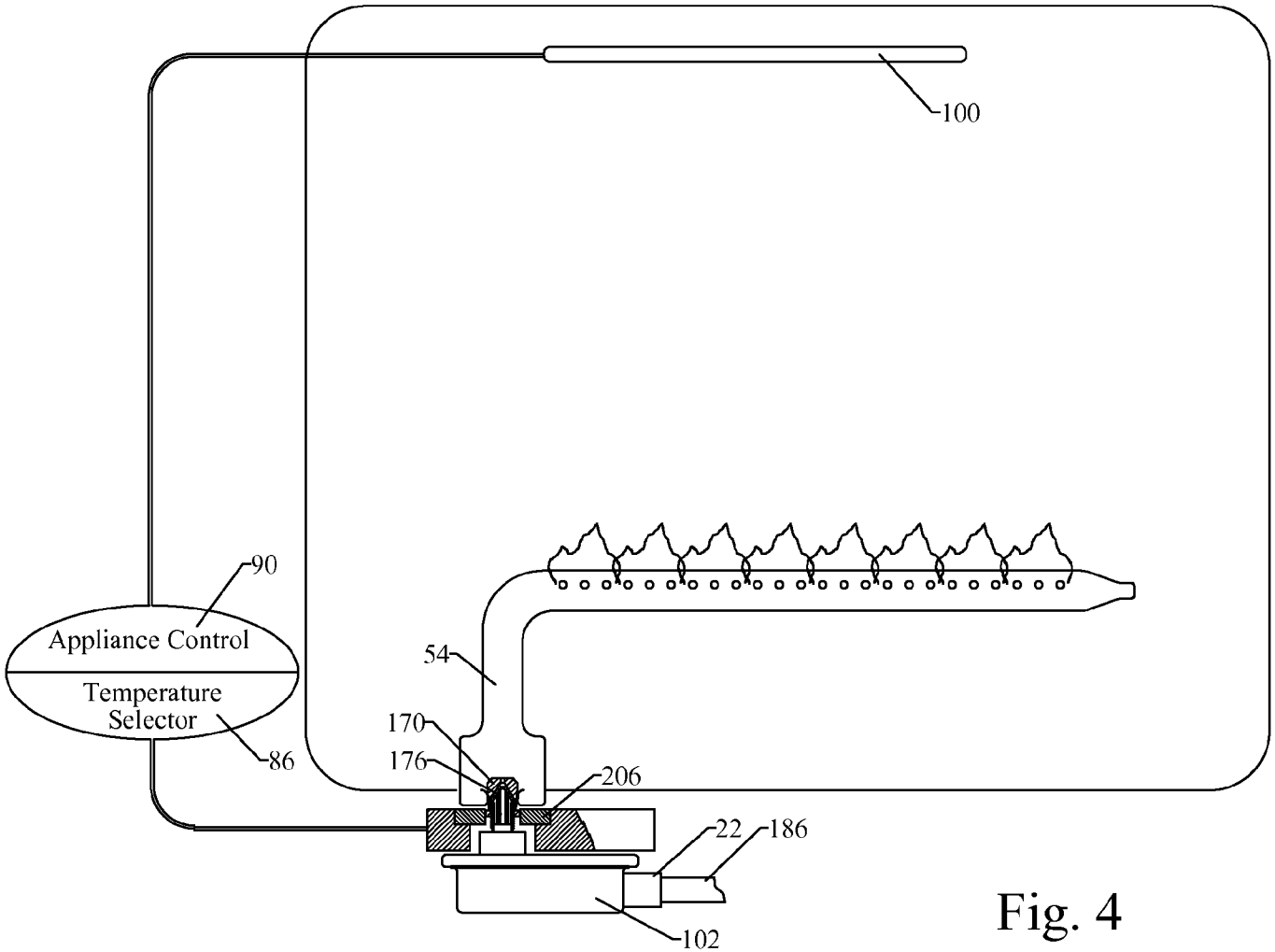
FIG. 4 is a schematic diagram of a gas appliance temperature control system including the valve of FIG. 8, a burner, and temperature controls.
Figure 14:
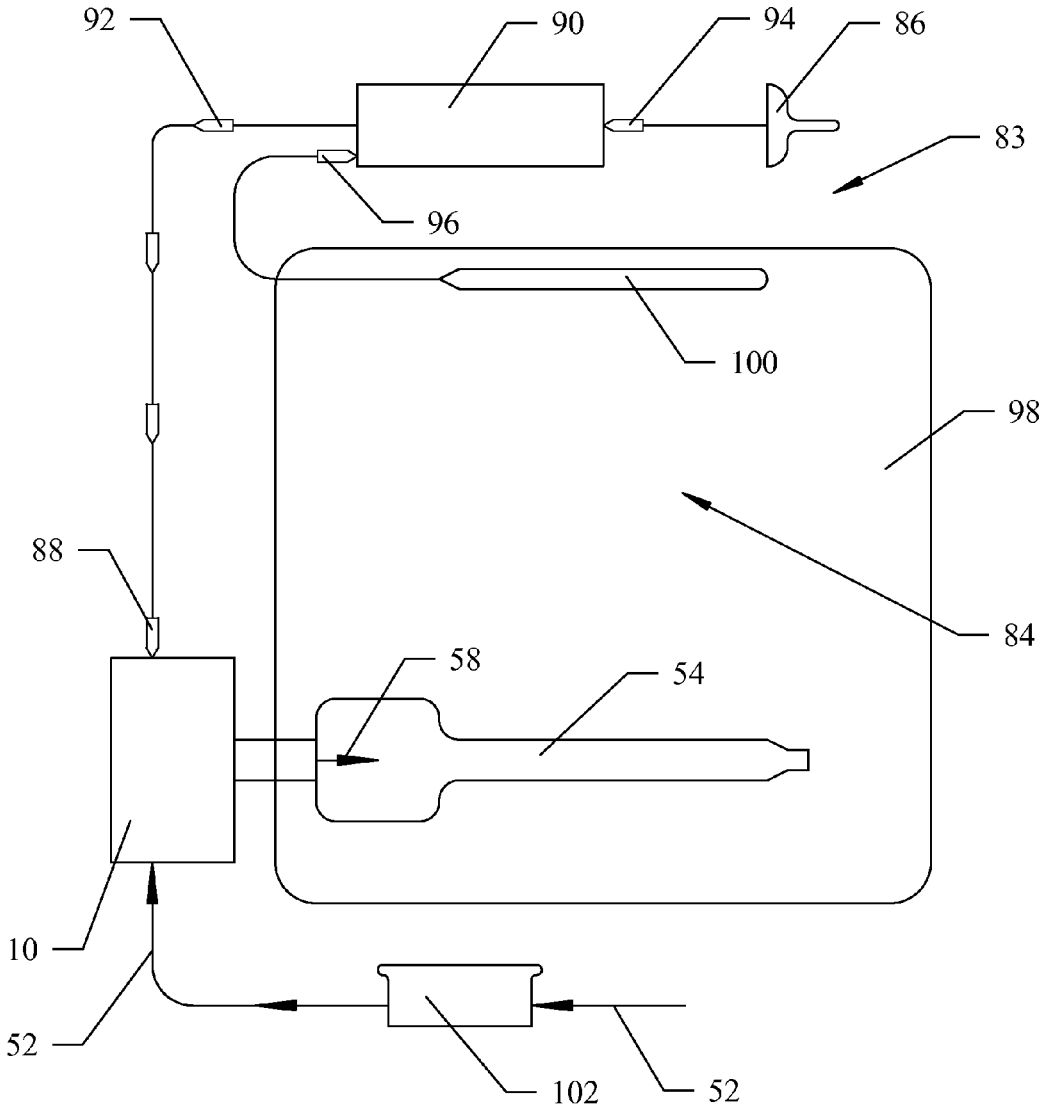
FIG. 14 is a schematic diagram of an exemplary temperature control system operable for use with any of the valves constructed according to principles of the present teachings.

FIGS. 4 and 14 illustrate an exemplary temperature control system 83 used in conjunction with one or more of the variable orifice gas flow modulating valve implementations of the present teachings. The temperature control system maintains a constant or substantially constant temperature in a gas appliance compartment 84 (such as, for example, an oven) as selected, for example, on the appliance temperature selector 86 by user. The temperature control system operates the actuator 12 to position the metering pin 16 within the orifice hood 18, thus controlling the volume of gas flow 58 allowed to pass through the orifice 20 into the burner 54 as determined by the position of the tapered portion of the metering end 44 of the pin 16 in relation to the tapered portion of the orifice hood countersink 62.

Thus, the control system is operable to maintain a substantially constant temperature in the gas appliance by positioning the actuator at any of a plurality of intermediate positions between an open position and a closed position. The actuator 12 output, and the resulting shaft 30 and metering pin 16 movement and position, is controlled by, and related to, a control signal input 88 from a programmable controller 90 whose output 92 is determined by calculations performed by the programmable controller 90 based on inputs 94 and 96 respectively from the temperature selector 86, typically located on a front panel of the gas appliance 98 for convenient human interface, and a temperature sensor 100 located in the gas appliance compartment 84. Thus, a constantly stable temperature is maintained, without the repeated cycling on and off of a gas control valve 102 as controlled by a conventional thermostat control system, by the application of a closed-loop, interactive control system comprised of a temperature selector 86, temperature sensor 100, programmable controller 90 and variable orifice gas flow modulating valve 10.

Figure 7:
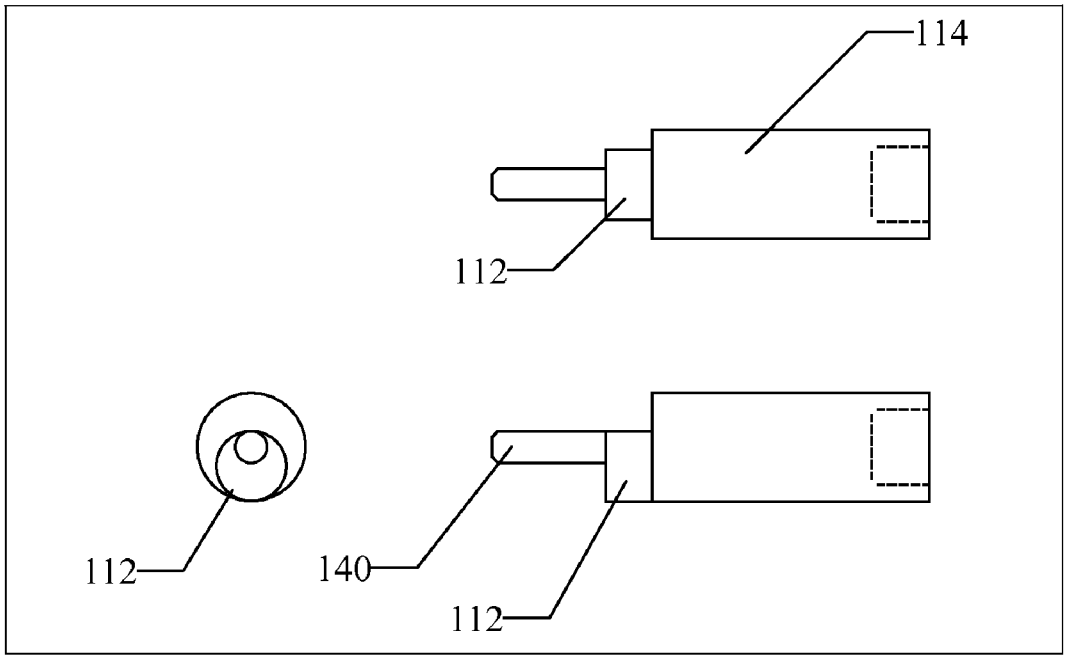
FIG. 7 is a cam element for use with the valve of FIG. 5, the cam element drivingly secured to the actuator and engaging the metering pin.
Figure 6:
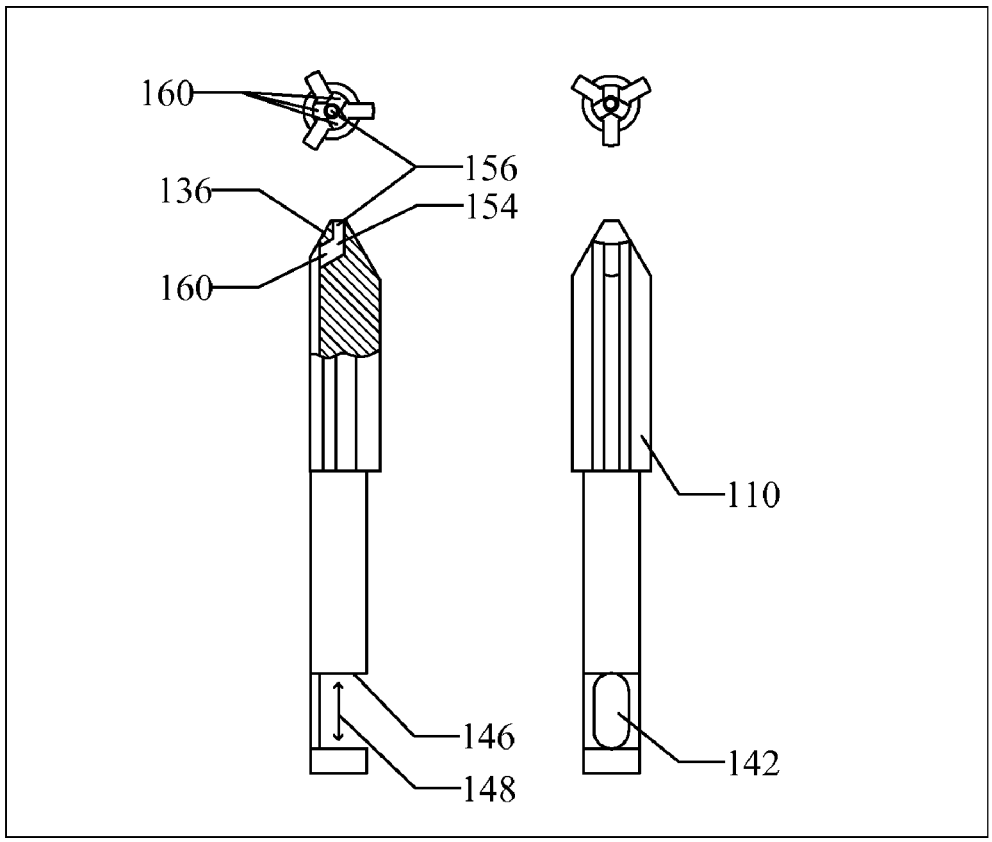
FIG. 6 is a metering pin for use with the valve of FIG. 5, the metering pin including an elongated slot for receiving a cam element connected to the actuator.

FIGS. 5-7 illustrate a gas flow modulating valve 104 incorporating principles of the present technology according to a second implementation. The valve 104 uses an actuator 106 attached to a side of a gas fitting body 108, generally perpendicular to a metering pin 110, with a cam 112 configuration on a drive shaft 114 for inducing a linear motion 152 to the metering pin 110.

The actuator 106 may be a servomotor, linear stepper motor, or any other type of a wide variety of electric devices that provide an electrically, variably controlled rotation of the output shaft. The servomotor 106 employed in this illustration is attached on the side of the gas fitting body 108 via normally acceptable means including rivets, screws, bolts or other equivalents in a manner such that an output shaft 118 centerline is axially perpendicular to and intersecting with the centerline of the metering pin 110.

The gas fitting body 108 is similar to that of FIG. 1 except having the gas inlet connection 120 on the opposite end from an outlet port 122, with a precision drilled hole 124 on the side of the gas fitting body 108 for assembly and alignment of the drive shaft 114, having an adjacent counterbore 126 for assembly of an o-ring 128 to provide a gas tight seal around the drive shaft 114, having a gas passageway 130 between the gas inlet connection 120 and the outlet port 122. The outlet port 122 could be of a similar construction as that of FIG. 1, with an orifice hood 18 assembled onto a threaded outlet port 36, or, as shown here, of an alternate one-piece construction, having an outlet port 122 with a precision machined bore 132 for alignment of a body diameter of the metering pin 110, having a precision machined countersink taper 134 of the same angle as the metering pin 110 end taper 136, with a precision drilled orifice hole 138 of a size to provide for the gas appliance specified maximum gas flow, and with an outside construction the same as that of the orifice hood 18 of FIG. 1 in order to properly assemble into a standard gas appliance burner inlet port.

A drive shaft 114 is assembled onto the output shaft 118 of the actuator 106 by some permanent, secure means such as threads, press fit, weld or cross-pin, having a precision machined diameter for alignment in the gas fitting bore 124 and gas tight sealing with the o-ring 128, with a small diameter end 140 for assembly through the metering orifice pin 110 elongated slot 142 and into the hole 144 of the gas fitting 108, and having the off-center precision machined cam 112 in a position to contact the surface 146 of the driving slot 148 on the metering pin 110 such that when rotated 180 degrees (see reference numeral 150) it will cause a linear movement 152 of the metering pin 110.

The metering pin 110 has an outside diameter for alignment in the gas fitting bore 132 having a machined tri-lobular cross-section for a gas passageway similar to the passageway 50, illustrated in FIG. 2, with the precision machined slot 148 for receiving the cam 112 of the drive shaft 114 and having the elongated slot 142 for engaging the drive shaft 114, and having an end construction the same as that of the metering pin 16 of FIG. 1, including the fins 48, an inside back hole 154, an orifice hole 156 sized to provide the specified minimum gas flow of the gas appliance, an end taper 136 of an angle matching the inside taper 134 of the outlet port 122, and having cross-drilled holes 160 or slots to provide a gas passageway 162 to the inside end of the metering pin orifice hole 138.

A spring pin 164 is assembled into the end of the metering pin 110 to maintain a constant pushing force 166 on the drive shaft to keep the cam 112 in constant contact with the driving surface 146 of the metering orifice pin 110 in order to prevent looseness or end-play between the cam 112 and the driving surface 146 during rotation 150 of the drive shaft 114.

A constant pressure gas flow 52 is delivered to the gas inlet connection 120 and through 162 the gas passageways to the orifice hole 138 for direct modulated flow 58 directly into the burner 54 for improved combustion as discussed above.

Referring to FIG. 14 for temperature control illustration purposes, constant temperature in the gas appliance compartment 84, as selected on the appliance temperature selector 86, is achieved similarly to FIG. 1 via an output signal 92 from the controller 90 being received by the actuator 106 causing a controlled rotation 150 of the drive shaft 114 and cam 112, imparting a linear motion 152 on the metering orifice pin 110, thus controlling the linear position of the metering orifice pin 110 end taper 136 in relation to the outlet port 122 countersink taper 134.

Figure 8:
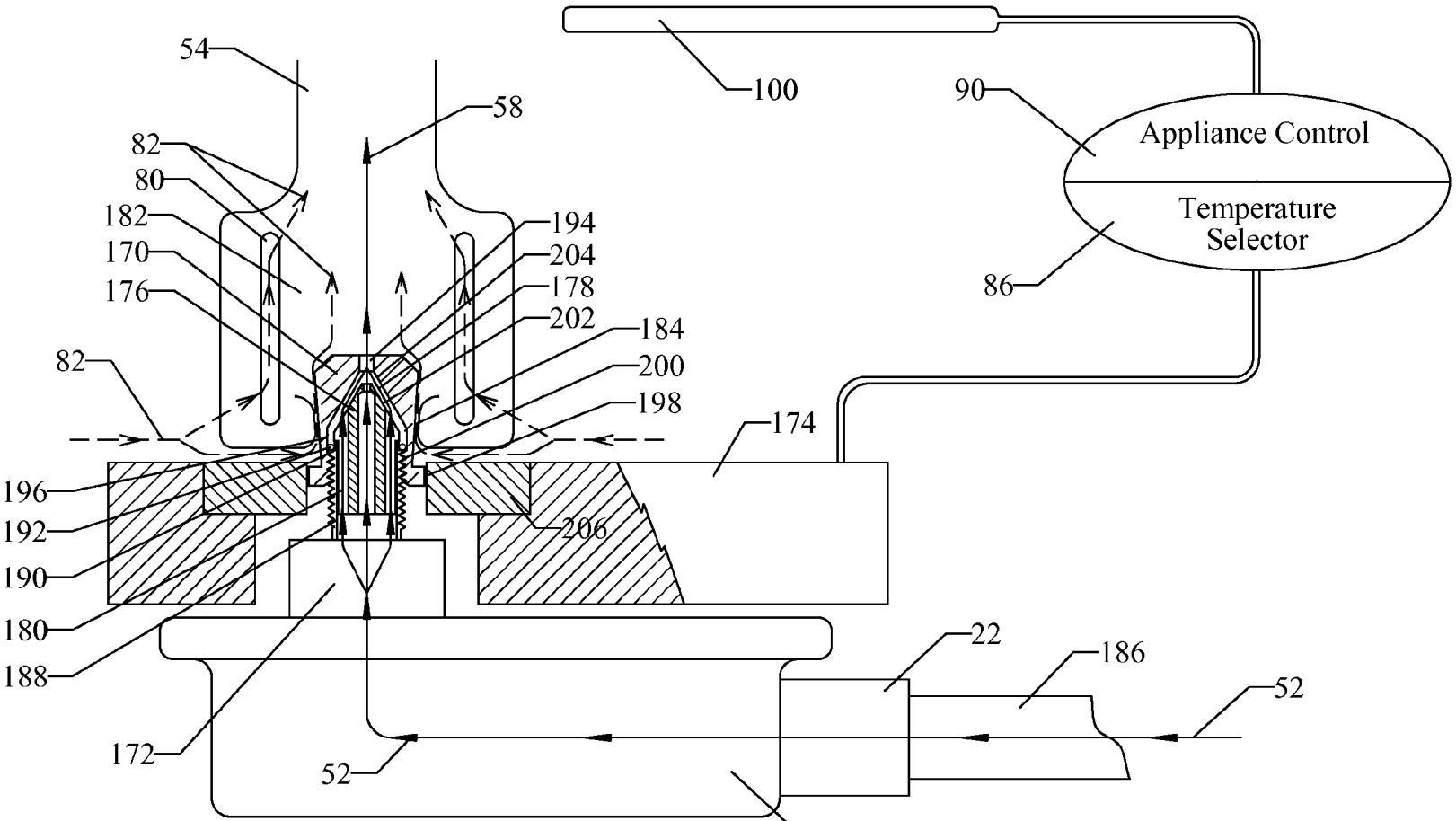
FIG. 8 is a variable orifice gas flow modulating valve incorporating principles of the present technology according to a third implementation, the valve including a fixed metering pin, a rotatable orifice hood threadedly secured to a gas valve body, and an actuator for rotating the orifice hood and thereby modulating gas flow through the valve.
Figure 9:
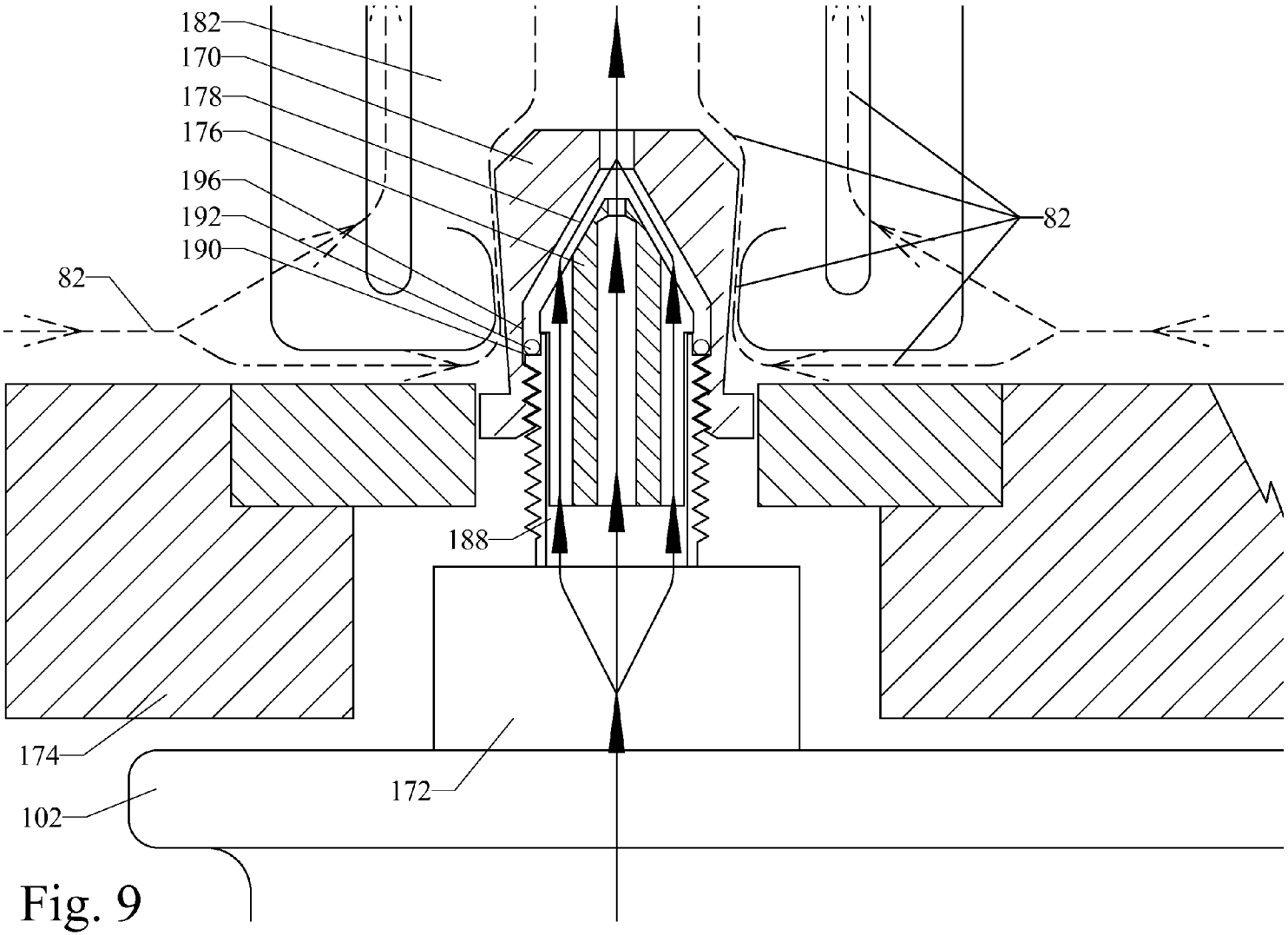
FIG. 9 is a cross-sectional view of a portion of the valve of FIG. 8, including the metering pin, orifice hood, and actuator.

FIGS. 8 and 9 illustrate a variation of the present invention that employs a reverse taper outer-diameter orifice hood 170 assembled onto an outlet port 172 of a gas safety valve 102 and incorporating a hollow shaft type electric motor actuator 174 to variably position the orifice hood 170 in relation to an orifice pin 176, effecting a metering action on the flow 58 to the burner 54, while still maintaining a constant pressure gas flow 52, 180, 178 immediately upstream of the orifice 170. It will be appreciated that the actuator 174 may alternatively be a pneumatic hollow shaft type actuator or any actuator operable to impart the desired movement to the hood 170, including custom actuators. As shown on the drawing, an additional feature of this invention is modulation of primary air flow 82 into a mixer tube 182 of the burner 54 as the orifice hood 170 is adjusted relative to the orifice pin 176, accomplished by the reverse taper 184 on an outer diameter of the orifice hood 170.

The gas safety valve 102 is comprised of a gas inlet connection 22 for connection to a gas supply line 186 attached to or integral with the gas appliance application, an outlet port 172 comprising a precision drilled hole 188 for an interference press fit assembly of the orifice pin 176, a machined shoulder 190 on the end of the outlet port 172 and external threads for assembly of the orifice hood 170.

An alternate construction could employ a gas fitting body 14 as described in FIG. 1 with modifications to the outlet port 172 as illustrated in FIG. 8 and described above, and without the opposite end hole 28 as shown in FIG. 1.

A sealing member 192, such as a conventional o-ring, is assembled onto the shoulder 190 of the outlet port 172 to create a gas tight or substantially gas tight seal between the orifice hood 170 and the outlet port 172.

The reverse taper orifice hood 170 has a reverse angle taper 184 on the outside diameter, a precision drilled orifice diameter 194 of a drilled size for providing the gas appliance with the maximum specified gas flow, a precision machined inside diameter surface 196 for a gas tight seal with the sealing member 192, a hexagon portion 198 to be used as a driving surface for turning down the orifice hood 170 towards the orifice pin 176, with internal threads 200 with a slip fit sufficient to allow free turning on the outlet port 172, and is assembled onto the outlet port 172 of the gas safety valve 102 with the sealing member 192 for a gas tight seal.

The orifice pin 176 is assembled into the outlet port 172 of the gas safety valve 102 with an interference press fit sufficient to hold the orifice pin 176 in place and in alignment with the orifice hood 170. The metering pin 176 may include fins similar to the fins 48 illustrated in FIG. 2 to create three gas passageways 50 for the gas flow 180 to pass through the gas fitting outlet 172 to enter the orifice 194 of the orifice hood 170. The metering taper end 202 of the orifice pin 176, and an internal countersink 204 of the orifice hood 170, are both machined with matching angle tapers, 202 and 204, such that the gas flow 178 approaching the orifice 194 is constricted, reducing or modulating the exiting gas flow 58, as the orifice hood 170 is turned down and approaches closer to the orifice pin end taper 202.

The actuator 174 is securely attached to the gas safety valve 102 via conventional means such as rivets, screws, bolts, clamps, brackets or other suitable means of permanent attachment. The hexagon driver socket 206 is assembled over the orifice hood 170 for rotating, or turning down, the orifice hood 170 to a controlled position with relation to the orifice pin 176 to meter the gas flow 178 based on an input signal from the gas appliance control system. The actuator 174 and driver socket 206 may be similar to what is commonly referred to in the art as a "nut runner."

A constant pressure gas flow 52 is delivered to the gas safety valve 102 through a gas supply line inlet connection 22, through the gas safety valve 102, and then through 180 the three gas passageways 50 (referring to FIG. 2) formed by the fins 48 of the orifice pin 176. Constant temperature in the gas appliance compartment is achieved through operation of the actuator 174 controlling the orifice hood 170 position in relation to the orifice pin 176, directly controlling the volume of gas flow 58 allowed to pass through the orifice 194 into the burner 54 as determined by the position of the orifice pin end 202 in relation to the orifice hood countersink taper 204. In addition to the normal drawing of primary air 82 through the mixer tube 182 air intake shutter 80, primary air 82 is further metered through the variable passageway between the orifice hood 170 reverse tapered 184 outside diameter and the mixer tube 182 inlet port. The actuator 174 rotation, and resulting orifice hood 170 movement and position, is linearly controlled by, and directly related to, a control signal input from a gas appliance control system whose output is determined by calculations based on inputs from a temperature selector and a temperature sensor located in the gas appliance compartment thus maintaining a constantly stable, non-fluctuating temperature in the gas appliance compartment through the direct modulation of the gas flow 58 and resultant turning down and modulation of the gas flame to supply the required heat to maintain the selected temperature, without the repeated cycling on and off of the gas safety valve 102 as controlled by a typical thermostat control system.

FIG. 4 is an illustration of a conventional residential gas range burner 54 with the orifice hood of FIGS. 8 and 9 positioned at least partially inside a burner inlet port. While FIG. 4 illustrates the combination of the burner 54 and the orifice hood 170 of FIGS. 8 and 9, the present teachings contemplate using the configuration of FIG. 4 with each of the gas valve implementations disclosed herein, wherein an orifice hood of the valve is placed at least partially within a burner inlet port, or opens directly into the burner inlet port.

Figures 10, 11:
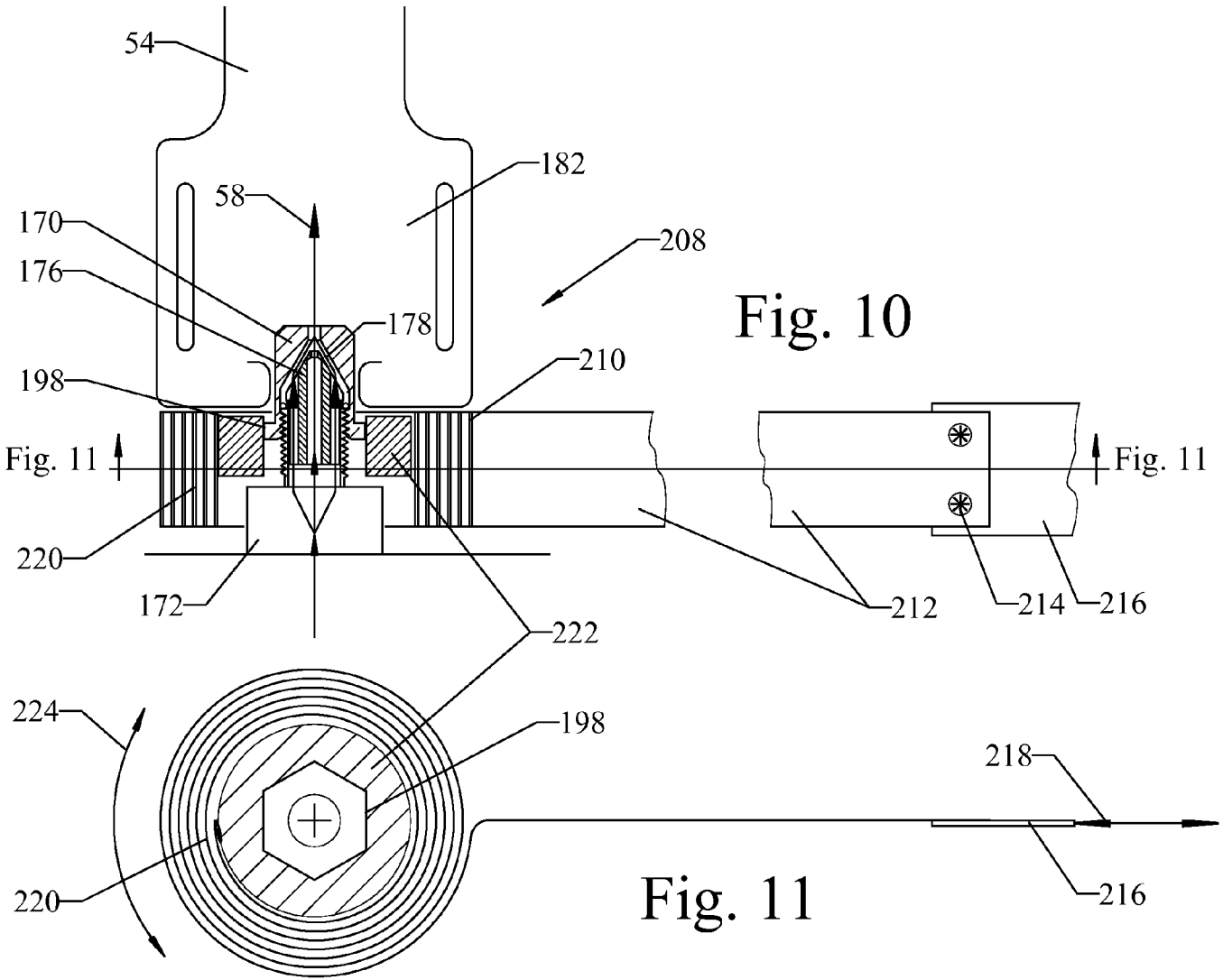
FIG. 10 is a side elevation view of a variable orifice gas flow modulating valve incorporating principles of the present technology according to a fourth implementation.
FIG. 11 is a cross-section view of the valve of FIG. 10 taken along line 11-11.

FIGS. 10 and 11 illustrate another variation of a variable orifice gas flow modulating valve 208 similar to that of FIGS. 8 and 9, except that the valve of FIGS. 10 and 11 includes the non-typical orifice hood 170 and further includes a bimetallic element actuator 210 positioned in the gas appliance working compartment, that responds to the actual ambient temperature in the compartment, and directly adjusts the orifice hood 170 in relation to the orifice pin 176 accordingly, thus metering the gas flow 178 and modulating the gas flow 58 directly into the mixer tube 182 of the burner 54.

The bimetallic element actuator 210 is comprised of a bimetallic strip 212, positioned in the gas appliance working compartment such that it responds to the actual ambient temperature in the compartment, attached by fasteners 214 to a temperature selector slide 216, that responds to an input signal 218 from the temperature selector device on the gas appliance, and terminates on the other end in a bimetallic coil 220 that is attached to a socket driver 222. The bimetallic element actuator 210 is positioned by a secure, permanent means onto an outlet 172 such that the socket driver 222 engages the hexagon surfaces 198 of the orifice hood 170. The bimetal strip 212 and bimetal coil 220 respond to temperature changes in an expansion and contraction manner, imparting a rotational movement 224 that turns the orifice hood 170 in response to temperature changes, resulting in a metering action on the gas flow 178 resulting in a constant, non-fluctuating temperature in the gas appliance as described in the FIG. 8 illustration.

One clear advantage of this variation is that it does not require electrical power to drive the actuator mechanism. It does, however, require an input, such as the input 218, either mechanical or electrical, from the gas appliance temperature selector in order to properly position the temperature selector slide 216.

Figure 12:
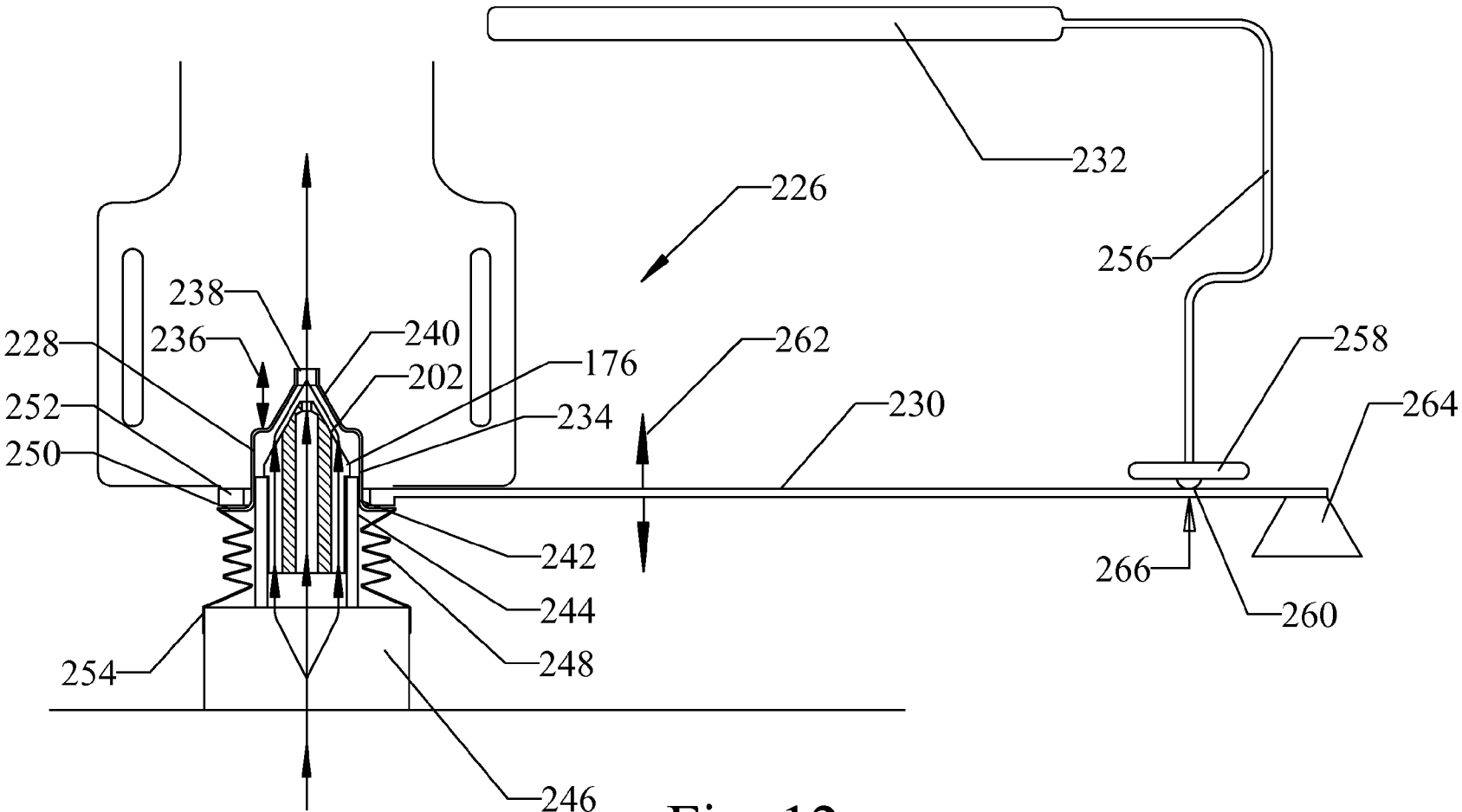
FIG. 12 is a side elevation view of a variable orifice gas flow modulating valve incorporating principles of the present technology according to a fifth implementation, the valve including a bellows-type design that permits use of a straight push linear motion from a lever operated by an actuator responding to a signal from a temperature controller.

FIG. 12 is a further variation of a variable orifice gas flow modulating valve 226 utilizing an orifice hood 228 in a bellows type design that permits use of a straight push linear motion from an actuator lever 230 responding to a temperature induced movement from a temperature sensor 232 positioned in the gas appliance compartment to perform a metering action on the gas flow.

This variation is comprised of the orifice hood 228 formed of a sufficiently thin material 234 as to allow a linear flexing movement 236, with a precision drilled or extruded fixed orifice hole 238, a countersunk angle taper 240 immediately adjacent to the inside end of the orifice hole 238, a precision drilled or formed inside diameter 242 adjacent to the end of the countersunk angle taper 240 to serve as an alignment surface 242 with the outside diameter 244 of the outlet port 246, a formed lower portion of a bellows 248 type construction designed to allow the linear flexing movement 236 of the orifice hood 228 to meter gas flow between the hood taper surface 240 and the orifice pin 176 end taper surface 202, a flat surface 250 to provide a contact surface with a lever actuator end 252, and a secure means of mounting, such as a seam weld 254, on the outlet port 246 providing a gas tight or substantially gas tight seal.

The orifice pin 176 is assembled with an interference fit in the outlet port 246 of either a gas safety valve or gas fitting body, as illustrated in FIG. 1.

The outlet port 246 may be the same as that illustrated in FIG. 8 and described above except without the external threads, instead having a precision machined surface 244 for axial alignment of the orifice hood 228 with the orifice pin 176.

The temperature sensor 232 is positioned in the gas appliance compartment such that it is responsive to the actual, ambient temperature of the compartment, having a capillary tube 256 attaching it to an expansion disk 258, and being filled with an expansion type fluid that responds in an expansion and contraction manner to temperature, with a contact point 260 for applying an expansion force onto the lever 230, imparting a linear motion 262 to the end 252 of the lever 230.

The lever 230 is fixed at one end 264 in the gas appliance compartment, having a contact point 260 of the expansion disk 258 in contact with the actuator lever 230 applying a linear force and resulting movement 262, with an opposing input force or signal 266 from the gas appliance temperature selector on the opposite side of the contact point 260, with the opposite end 252 in contact with the orifice hood 228 top surface 250 to provide the linear action 236 on the orifice hood 228 for linearly positioning the inside taper surface 240 of the orifice hood 228 at a fixed position with relation to the orifice pin 176 end taper surface 202 to meter gas flow through the orifice 238 into a burner mixer tube resulting in a constant, non-fluctuating temperature in the gas appliance as described in the FIG. 8 illustration.

Similar to the advantage described in FIGS. 10 and 11, this variation does not require electrical power to operate the actuator mechanism, but it does require an opposing adjustment means, either mechanical or electrical, from the gas appliance temperature selector in order to provide an input 266 to properly compensate for the temperature in the gas appliance compartment.

A further variation of this method may employ either an electromagnetic solenoid, electric linear stepper motor, or other similar electrical device that provides a variably controllable linear force or motion 236 on the orifice hood 228 flat surface 250.

Figure 13:
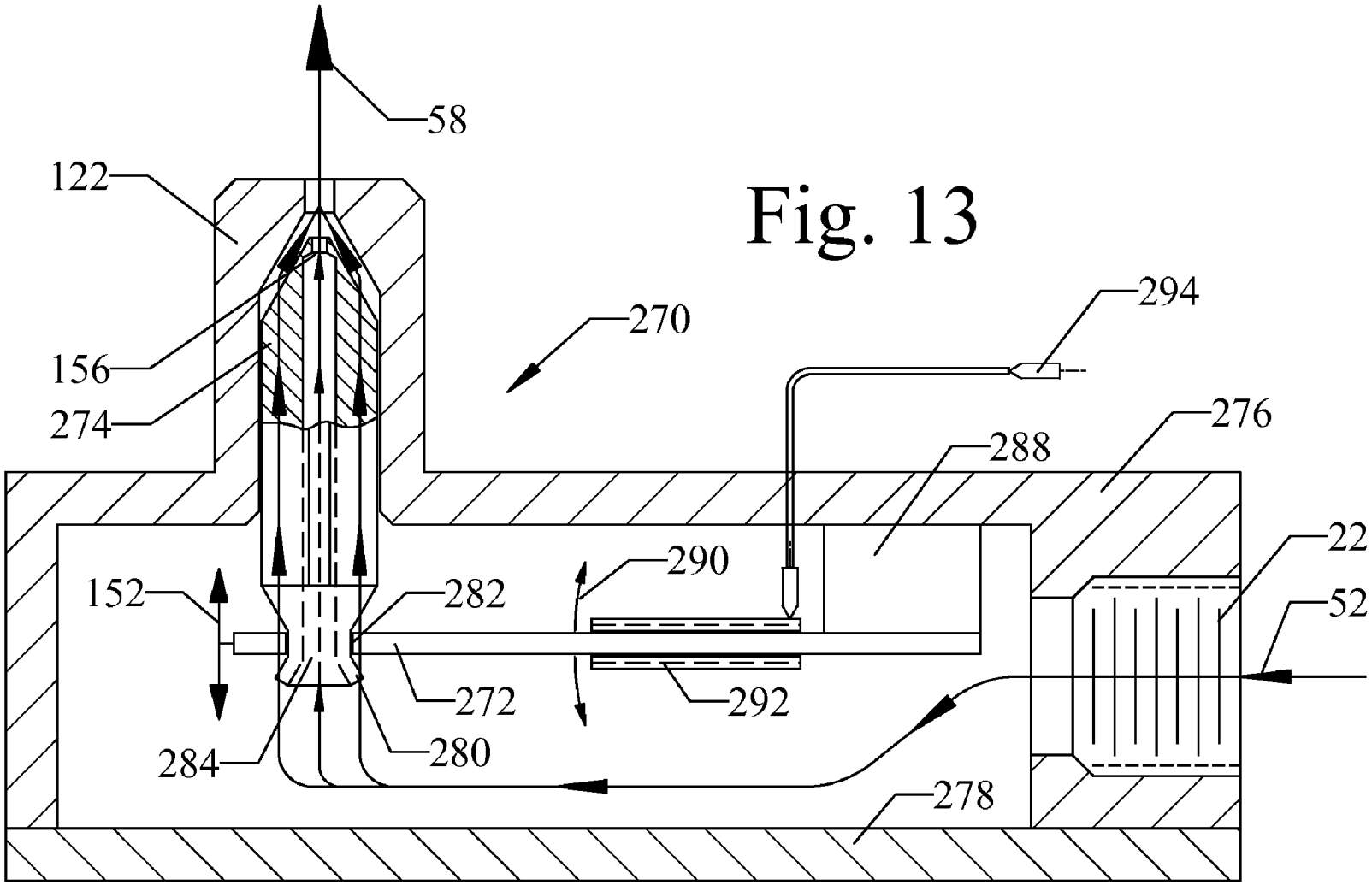
FIG. 13 is a side elevation view of a variable orifice gas flow modulating valve incorporating principles of the present technology according to a sixth implementation, the valve including a fixed orifice hood and a bimetallic lever.

FIG. 13 is a further variation of a variable orifice gas flow modulating valve 270 including a fixed orifice hood 122 similar to that illustrated in FIG. 5, and further having an internal bimetallic lever 272 providing linear motion to the orifice metering pin 274.

The valve 270 is comprised of a valve body 276 having an inlet port 22 and one-piece outlet port orifice hood 122 as previously described and illustrated in FIG. 5. The valve body 276 additionally has one open side to allow assembly of internal components, then being assembled with a cover 278 to provide a gas tight seal, though not limited to this embodiment as other normal manufacturing methods could permit assembly of the internal bimetallic lever 272 without having the open side and cover 278, such as inserting the lever 272 through an open port from the side. The orifice hood 122 outlet port is the same construction as that described in FIG. 5, including the precision orifice hole and internal taper for metering gas flow as previously described and illustrated in FIG. 5.

The metering pin 274 is a similar construction as that described above and illustrated in FIG. 5, except having one end machined for assembly 280 to the end hole 282 of the bimetallic lever 272 via the coin-over 280 as illustrated in FIG. 13, or any other conventional manufacturing methods such as threads, screws, bolts, rivets, pins, stakes, weld links, and so forth. In addition, the metering pin 274 has a back hole 284 providing an internal gas passageway to the inside end of the metering pin orifice hole 156. The other end of the metering pin 274 is the same as that described above and illustrated in FIG. 5, including the tri-lobular construction and end taper.

The valve 270 has an internal bimetallic lever 272, securely attached to a valve body 276 via an internal surface or mounting block 288, for providing linear motion to the metering pin 274 assembled to the hole 282 in the end. The bimetal lever 272 is of a bimetallic material that responds with a bending motion 290, resulting in a controlled linear motion 152 at the end of the lever 272, when heat is applied via an electrical heater coil 292 that is supplied a controlled variable electrical signal 294 from a temperature control system, such as the system illustrated in FIG. 14 and described above.

A constant pressure gas flow 52 is delivered to the gas fitting body 276 through a gas supply line inlet connection 22. Modulated gas flow 58 for control of temperature in a gas appliance is accomplished in a similar manner as previously described and illustrated in FIG. 5 and as illustrated in the temperature control system in FIG. 14.

As explained above, FIG. 14 is an illustration of an exemplary temperature control system for a gas appliance, the system utilizing a variable orifice gas flow modulating valve of any of the previously described configurations directly responding to a sensed temperature, in relation to a selected temperature, and modulating the gas flow, thus the flame and heat output, shown for illustrative purposes in application on a residential gas oven 98. This description is non-limiting and solely for the purpose of illustration, and as such could be easily applied in principle to other gas appliances such as gas furnaces, gas water heaters, gas-fired boilers, gas grills, gas commercial ovens, and other similar gas appliances using gas controls.

Constant temperature in the gas appliance compartment 84, as selected on the appliance temperature selector 86, is achieved through operation of the actuator 12 (see FIG. 1 for component details) controlling metering pin 16 positioning within the orifice hood 18, directly controlling the volume of gas flow 58 through the orifice 20 into the burner 54 as determined by the position of the metering pin end 44 in relation to the orifice hood countersink 62. The actuator 12 output, and resulting shaft 30 and metering pin 16 movement and position are controlled by, and related to, the control signal input 88 from the programmable controller 90 whose output 92 is determined by calculations performed by the programmable controller 90 based on inputs 94 and 96, respectively, from the temperature selector 86, typically located on a front panel of the gas appliance 98 for convenient human interface, and a temperature sensor 100 located in the gas appliance compartment 84. This signal could be a variable value such as, for example, 4-20 milliamps for positioning an actuator in direct proportion to the value of the signal, or a single signal, repeated a certain amount as necessary, applied to a stepping device to cause it to incrementally move or step a proportional amount and direction. Thus a constantly stable temperature is maintained through direct modulation of the gas flow and flame, without the repeated cycling on and off of the gas control valve 102 as controlled by a typical thermostat control system, by the application of a closed-loop, interactive control system comprised of a temperature selector 86, temperature sensor 100, programmable controller 90 and variable orifice gas flow modulating valve 10.

Although the invention has been described with reference to the preferred embodiments illustrated in the attached drawings, it is noted that equivalents may be employed and substitutions made herein without departing from the scope of the invention as recited in the claims.

Having thus described a preferred embodiment of the invention, what is claimed as new and desired to be protected by Letters Patent includes the following:

1. A variable orifice gas flow modulating valve comprising:

an orifice hood with a wall defining a recess and an outlet orifice, the recess including a tapered section that narrows from a wide portion to a narrow portion, the outlet orifice extending from the narrow portion of the recess through the wall to an outer surface of the orifice hood;

a metering pin including— a central portion extending along a length of the metering pin, and a plurality of fins, each fin extending radially outwardly from the central portion and extending only along a portion of a length of the metering pin, the fins and central portion being tapered at an end of the metering pin such that the tapered portion of the metering pin conforms to the tapered section of the recess, the metering pin including a passage for allowing gas to pass through the metering pin to the outlet orifice, the fins being spaced apart along a circumference of the metering pin with an elongated four-sided opening between each pair of fins allowing gas to flow from the recess to the passage, each opening extending approximately half the length of the fins; and an actuator comprising an electric motor mechanically linked to the metering pin and operable to rotate a threaded rod that is substantially parallel with a longitudinal axis of the metering pin for moving the pin between an open position where the metering pin is separated from the tapered section of the recess by a first distance and allows gas to flow around an outer surface of the tapered portion of the pin to the outlet orifice, at a first rate, an intermediate position where the metering pin is separated from the tapered section of the recess by a second distance and allows gas to flow around an outer surface of the tapered portion of the pin to the outlet orifice at a second rate, and a closed position where the tapered portion of the metering pin is seated against the tapered section of the recess and restricts substantially all gas flow to the passage of the metering pin and the outlet orifice, wherein the second distance is less than the first distance and the second rate is less than the first rate, wherein the actuator is operable to move the metering pin without removing the orifice hood and the actuator is operable to continuously adjust a flow of a gas through the outlet orifice.

2. The variable orifice gas flow modulating valve as set forth in claim 1, the passage including an axial through-hole extending from the tapered portion of the metering pin axially through the central portion along a portion of the length of the metering pin.

3. The variable orifice gas flow modulating valve as set forth in claim 2, the passage including a plurality of lateral through-holes, each lateral through-hole extending from an outer surface of the central portion to the axial through-hole.

4. The variable orifice gas flow modulating valve as set forth in claim 1, the actuator operable to maintain the pin at any of a plurality of intermediate positions between the open position and the closed position.

5. The variable orifice gas flow modulating valve as set forth in claim 1, further comprising a gas fitting body including— a gas inlet fitting, an internal passageway from the inlet fitting to the metering pin, and a bore for receiving an actuator shaft.

6. The variable orifice gas flow modulating valve as set forth in claim 5, further comprising a sealing member interposed between the actuator shaft and the gas fitting body.

7. A gas appliance comprising:

a burner;

an orifice hood including a wall defining a recess and an outlet orifice, the recess including a tapered section that narrows from a wide portion to a narrow portion, the outlet orifice extending from the narrow portion of the recess through the wall to an outer surface of the orifice hood and feeding directly into the burner;

a metering pin including— a central portion extending along a longitudinal axis of the metering pin, and a plurality of fins each extending radially outwardly from the central portion and extending only along a portion of a length of the metering pin, the fins and central portion being tapered at an end of the metering pin such that the tapered portion of the metering pin conforms to the tapered section of the recess, the metering pin including a passage for allowing gas to pass through the metering pin to the outlet orifice, the fins being spaced apart along a circumference of the metering pin with an elongated four-sided opening between each pair of fins allowing gas to flow from the recess to the passage, each opening extending approximately half the length of the fins;

an actuator for moving the pin between an open position where the metering pin is separated from the tapered section of the recess by a distance and allows gas to flow around an outer surface of the tapered portion of the pin to the outlet orifice, and a closed position where the tapered portion of the metering pin is seated against the tapered section of the recess and restricts substantially all gas flow to the passage of the metering pin and the outlet orifice; and a control system for measuring an internal temperature of the appliance and driving the actuator in response to the internal temperature.

8. The gas appliance as set forth in claim 7, the control system driving the actuator toward the closed position if the internal temperature exceeds a selected level and driving the actuator toward the open position if internal temperature is lower than the selected level.

9. The gas appliance as set forth in claim 8, the control system operable to drive the actuator to any of a plurality of intermediate positions between the open position and the closed position.

10. The gas appliance as set forth in claim 9, the control system operable to maintain a substantially constant temperature in the gas appliance by positioning the actuator at any of the plurality of intermediate positions between the open position and the closed position.

11. The gas appliance as set forth in claim 10, the control system operable to receive an input from a user indicating the temperature.

12. The gas appliance as set forth in claim 7, the passage including an axial through-hole extending from the tapered portion of the metering pin axially through the central portion along a portion of the length of the metering pin.

13. The gas appliance as set forth in claim 12, the passage including a plurality of lateral through-holes, each lateral through-hole extending from an outer surface of the central portion to the axial through-hole.

14. A method of modulating gas flow in a gas appliance, the method comprising:

sensing a temperature with an electric sensor;

moving a metering pin with an electric motor toward a closed position in a recess of an orifice hood if the temperature is higher than a selected temperature but stopping the metering pin short of the closed position, the orifice hood including an outlet orifice opening directly into a burner of the gas appliance, the gas flow being constrained to a first passageway internal to the metering pin and the outlet orifice when the metering pin is in the closed position, wherein gas enters the first passageway through a plurality of elongated four-sided openings spaced apart along a circumference of the metering pin; and moving the metering pin toward an open position in the recess if the temperature is lower than the selected temperature but stopping the metering pin short of the open position, the gas flow following the first passageway and at least one additional passageway external to the metering pin along the recess to the outlet orifice when the metering pin is in the open position.

15. The method of claim 14, wherein the metering pin includes a fin positioned between each opening extending along a portion of the length of the metering pin.

* * * * *